US006752609B2

(12) United States Patent
Volokitin et al.

(10) Patent No.: US 6,752,609 B2
(45) Date of Patent: Jun. 22, 2004

(54) DEVICE FOR FORMING SYNTHETIC FIBER MATERIALS

(75) Inventors: Gennady Volokitin, Tomsk (RU); Viktor Gapeev, Gilhorn (DE); Serguey Zolov, Tomsk (RU)

(73) Assignee: Microfaser Produktionsgesellschaft mbH, Gifhorn (DE)

( * ) Notice: Subject to any disclaimer, the term of this patent is extended or adjusted under 35 U.S.C. 154(b) by 122 days.

(21) Appl. No.: 09/988,061

(22) Filed: Nov. 16, 2001

(65) Prior Publication Data

US 2002/0127291 A1 Sep. 12, 2002

(30) Foreign Application Priority Data

Mar. 12, 2001 (DE) ..... 101 12 089

(51) Int. Cl.[7] ..... D01D 5/08

(52) U.S. Cl. ..... 425/8; 425/DIG. 17; 239/223; 239/139

(58) Field of Search ..... 425/8, 425, DIG. 17; 264/211.1, 311, 503; 239/214, 222.11, 223, 224, 214.21, 132, 139

(56) References Cited

U.S. PATENT DOCUMENTS

| | | | | | |
|---|---|---|---|---|---|
| 2,192,944 | A | * | 3/1940 | Cullen | 65/516 |
| 4,468,241 | A | * | 8/1984 | Breidenthal, Jr. | 65/455 |
| 4,863,509 | A | * | 9/1989 | Metz | 75/333 |
| 5,346,377 | A | * | 9/1994 | Bogue et al. | 425/9 |
| 6,524,514 | B1 | * | 2/2003 | Volokitin et al. | 264/403 |

FOREIGN PATENT DOCUMENTS

| | | | |
|---|---|---|---|
| EP | 1236020 | | 6/1989 |
| EP | 2061129 | | 5/1996 |
| EP | 2117719 | | 8/1997 |
| JP | 06155455 | * | 8/1989 |
| JP | 01198410 | * | 6/1994 |
| RU | 2 174 165 | C1 | 12/2000 |
| WO | WO 99/35313 | | 7/1999 |

OTHER PUBLICATIONS

European Search Report dated Jun. 25, 2002.

XP–002101853 Derwent Publication Ltd.

XP 002203296 Derwent Publication Ltd.

Patent Specification 1 265 215 with drawings attached, filed Jul. 10, 1969.

* cited by examiner

*Primary Examiner*—Robert Davis
*Assistant Examiner*—Joseph S. Del Sole
(74) *Attorney, Agent, or Firm*—Whitham, Curtis & Christofferson, P.C.

(57) ABSTRACT

Fibers of improved quality can be produced with a reduced energy input in a device for producing synthetic materials which has a polymer melt feed leading to a rotating hollow reactor (1), the wall of which can be heated and which widens conically in order to guide a film melt towards an open side that can be closed with a lid (13), and which has ribs (4) for dividing the melt film into fibers that grow rigid after leaving the hollow reactor (1); and said improved quality can be achieved specifically in that the hollow reactor (1) is vertically oriented and exhibits a continuously curved inner wall and at the curved upper side exhibits an opening (3) for introducing the polymer melt, and in that a rotating distributor plate (12) is positioned opposite the opening (3), a slight distance from the inner wall of the hollow reactor (1).

12 Claims, 1 Drawing Sheet

DEVICE FOR FORMING SYNTHETIC FIBER MATERIALS

BACKGROUND OF THE INVENTION

1. Field of the Invention

The invention relates to a device for producing synthetic fiber materials, with a polymer melt feed leading to a rotating hollow reactor, the wall of which can be heated and which widens conically in order to guide a film melt toward an open side that can be closed with a lid, and with ribs for dividing the melt film into fibers that grow rigid after leaving the hollow reactor.

2. Background Description

Synthetic fibrous materials with a polymer melt feed can be employed in particular as absorption agents that filter mineral oil and oil products, as well as a series of heavy metal ions, out of water. The process for manufacturing thermoplastic fibrous material usually involves two stages, namely the production of the melt and the formation of the fibers.

In known facilities, the thermoplastic material is first melted and the melt is then extruded through spinnerets in order to form the fibers. An apparatus known from SU 1 236 020 A exhibits a loading bin, a current supply, and a melt lattice, with a distributor for heated inert gas. The distributors are triangular in shape and are positioned uniformly over the melt lattice forming the surface. In the space above the lattice the thermoplastic material being processed is uniformly heated to a temperature close to the melting point and can then pass without hindrance between the triangular distributors, in the process of which there is a treatment with nitrogen. Connection points for mounting heating elements are located in the housing for the melt lattice. The heated material is thus melted and in turn reaches a worm gear and is pressed through the nozzles and formed into a skein or a thread. With facilities of this kind fibers can only be produced from high-quality raw materials, and an even rhythm must be assured when the raw material reaches the melt lattice and as the melt reaches the worm for removal.

Facilities are known from GB 1 265 215 and SU 669 041 A in which the fibers are produced from a melt strip, so that the uniformity of the melt throughput is not critical. Here the strip from the melt is divided into individual skeins at the edge of the rotating reactor. The reactor is a horizontally positioned, two-part basin with a hollow space and a working surface. Located in the hollow space are gap-like openings. An energy carrier penetrates from the outer cavity of the reactor through the gap-like openings and divides the melt strip into individual skeins, works them from two sides, makes them thinner, and draws them into fibers. In order to obtain a high-quality fiber with this apparatus the energy carrier must have a higher temperature than the melting temperature of the polymer, as well as a adequate speed, so that the melt skeins can grow thinner and longer and thus be formed into a fiber. The opened reactor basin results in an energy loss and diminishes the effectiveness of the manufacturing process.

Known from RU 2 061 129, furthermore, is an apparatus for producing fiber materials which exhibits an extruder, a circular head that forms a thread and is provided with radially positioned channels that run together in the center, and air current generator which simultaneously draws out the melt skeins lengthwise and cools them until them have become fibers, and an element for cutting the finished fibers that exhibits an extension converging in the direction of the arriving thread. The fibers are deposited under the influence of a stiff air current, which is aimed in the direction of the extruded melt skeins. The radially positioned channels that run together in the middle also require the use of high-quality raw materials. Otherwise these channels become blocked with a mass of material that is not fully melted, and this makes further transport through the melt liens more difficult. The production of high-quality fibers from raw materials of lower quality is thus impossible.

Known from RU 2 117 719 is a device of the initially mentioned type, in which a horizontally positioned, rotating, cylindrical hollow reactor is externally heated. The open part of the reactor has the form of a cone which increases in size and is sealed with an immovable lid. The cone lid, together with the lateral surfaces of the widening cone, forms a gap of 15 to 20 mm. In addition, the inner surface of the reactor is provided with flat ribs that have a triangular form over their length; the ribs are oriented in the direction of the fiber formation and point toward the melt outlet.

The device is equipped with a circular high-pressure air supply. With this known device it is possible to process thermoplastic material consisting of industrial and domestic refuse while simultaneously increasing the output of high-quality fiber material. In actual practice, however, a problem arises in that with conventional heating elements and a cylindrically shaped reactor it is impossible to uniformly heat the reactor wall and floor.

Consequently the temperature of the reactor floor and of the terminal components are always lower than the reactor wall. The melt collects in the corners between the wall and the floor and thus forms a kind of standstill area, where the melt cools and tends to stick to the floor and the transitional areas between the floor and the walls. The formation of such standstill areas diminishes the productivity of the apparatus and has a negative effect on the fiber quality. Solid parts of the polymer can be drawn out of the standstill area and transported, together with the melt, to the terminal part of the reactor under the effect of centrifugal forces, to be released along with the fiber. The result is that the fibers are formed unevenly, with thickened areas or inclusions of solid, unmelted pieces that vary in shape; the quality of the fibers is thus diminished.

To clean the standstill area the facility must be regularly shut down and the adhering polymer mechanically removed. If the reactor walls were heated to a greater degree this would lead to considerable overheating of the melt film. Another disadvantage of the known device rests in the fact that more than 30% of the introduced heat energy is directly employed in heating the strip. The residual energy released by the heater is consumed in heating the reactor interior and the ambient air through the transfer of radiation energy.

Furthermore, due to the back radiation between the heater and the reactor in the central part of the reactor the heating elements and the melt strip become overheated. This may result in the heater being burned and to the partial or compete burnout of the polymer. When there is a uniform distribution of the heater capacity in the radial and axial direction, the main quantity of heat gathers in the upper portion of the heater. In this case, overheating and burning of the heating elements is also possible.

SUMMARY OF THE INVENTION

The present invention is based on the problem of improving a device of the initially indicated type for the manufacture of synthetic fiber materials and in such a way that the fiber quality is improved while the energy consumption is reduced.

The invention solves this problem in a device of the initially indicated type in that the hollow reactor is vertically oriented and exhibits a continuously curved inner wall and an opening on the curved upper side of the wall to introduce the polymer melt and in that a rotating distributor plate is positioned opposite the opening, at a slight distance from the inner wall.

The device according to the invention is designed for the production of a uniformly thin melt film which can move to the open side of the reactor due to the continuous curve of the inner wall, without the presence of standstill areas. The uniformly thin film is successfully formed in that the polymer melt is fed axially through an opening on the curved upper side of the hollow reactor and there reaches a rotating distributor plate, which is positioned at a slight distance from the inner wall of the hollow reactor. The fed molten polymer is thus collected and flung evenly onto the inner wall of the hollow reactor by centrifugal force. The distributor plate thus creates a seal for the supply opening while forming an annular gap with the inner wall of the hollow reactor, and the material collected on the distributor plate leaves this annular gap in evenly distributed form and reaches the inner wall of the hollow reactor. The speed of flow of the melt film on the inner wall of the hollow reactor is determined by the centrifugal force resulting from the rotation of the hollow reactor and additionally by the weight of the melt film, since the hollow reactor is vertically oriented and open below.

The distribution effect of the distributor plate is further improved in that the surface of the distributor plate rises toward the rim and will ideally form a curved surface that is concave in the direction of the opening. In a preferred embodiment a truncated cone is positioned on the distributor plate; the diameter of this truncated cone is smaller than the diameter of the distributor plate. Here the diameter of the upper side of the distributor plate can correspond in terms of magnitude to the diameter of the opening of the feed opening.

The continuously curved inner wall of the hollow reactor will ideally be parabolic in shape and will thus correspond to the surface that arises when a parabola is rotated around its own axis. Given the same height and the same diameter of the outlet opening, the continuous curve provides a considerably reduced inner volume compared to the known device, so that the quantity of heat energy required for heating the inner space is reduced. The invention design also minimizes the heat losses and the specific heat consumption.

In a particularly preferred embodiment of the invention the inner wall forms a curved gap in conjunction with a container surrounding the hollow reactor, to which a steam feed and a steam outlet are attached. The continuous circulation of heated water vapor through the hollow space results in the uniform heating of the reactor walls. It is thus possible to produce the melt strip or the melt film at a uniform temperature and thickness, with the result that the fiber exhibits a uniform diameter over its entire length and has no unmelted parts. To this end it is expedient for the steam feed and the steam outlet to be positioned on the upper and lower rim of the inner wall. The steam can then be guided in the polymer melt's direction of flow, as well as in the opposite direction.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
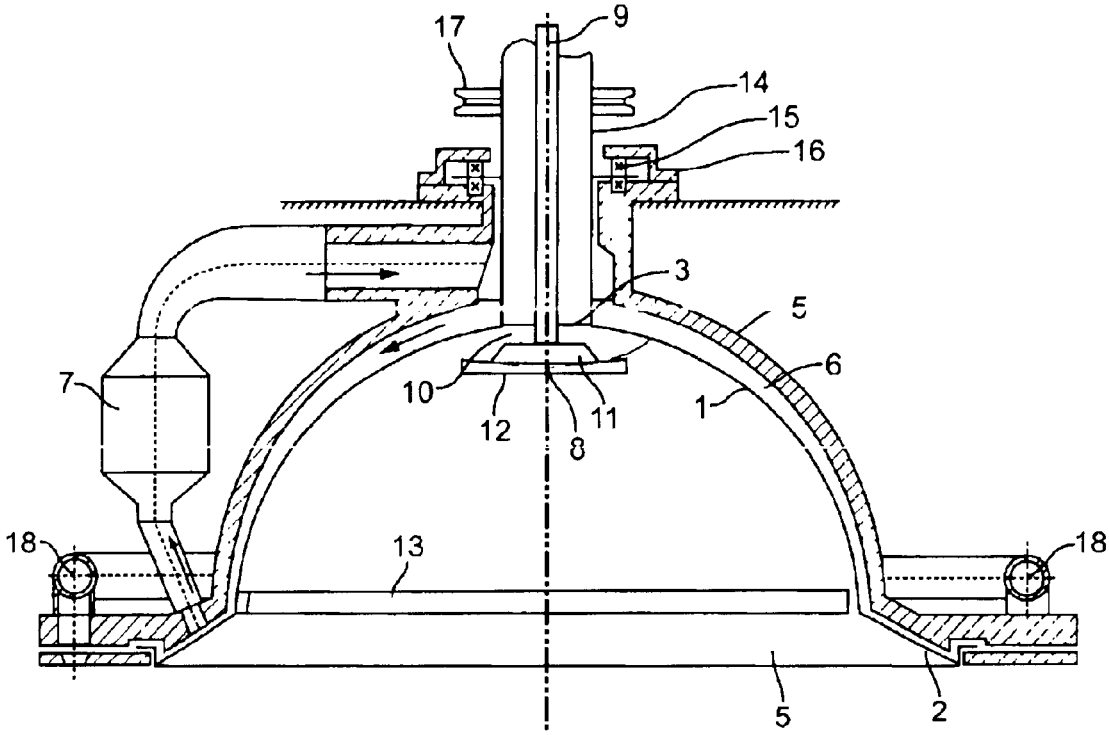
FIG. 1 depicts a vertical section through an exemplary embodiment of a device according to the invention.
Figure 2:
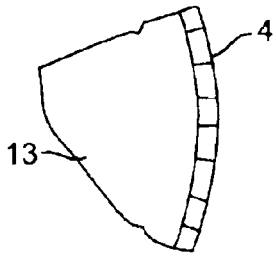
FIG. 2 depicts a partial view of the annular gap formed between the inner wall and the lid of FIG. 1.

The device shown in the drawing serves to produce fibers from a thermoplastic melt and comprises a vertically installed rotating hollow reactor 1 in the form of a paraboloid, which is created by rotating a parabola around its own axis. Provided on the open rim of the paraboloid is a rim 2 that widens to form a cone. Centrally positioned in the curved portion of the paraboloid is an opening 3 for introducing a polymer melt. The inner wall of the hollow reactor 1 is provided with flat ribs 4, which run vertical to the rim 2 in the lower area of the hollow reactor 1.

The hollow reactor 1 is located in a container 5 that encloses it and whose surface accommodates the shape of the hollow reactor 1 in such a way as to produce a curved gap 6. The upper part of the gap 6 is connected to the outlet and the lower part of the gap 6 to the intake of a steam generator 7, with the result that a closed steam circuit is formed by the gap 6. The direction of movement of the water vapor is indicated by the arrow in FIG. 1; here there is a unidirectional flow of the water vapor. By reversing the steam generator 7 it is likewise possible, and for some applications it is expedient, to also provide a counter-directional flow of the water vapor.

Located inside the hollow reactor 1, opposite the opening 3, is a distributor configuration 8 which is secured to a rod 9 running centrally through the feed opening 3. The rod 9 is axially adjustable, so that the distance of the distributing device 8 from the inner wall of the hollow reactor 1 can be adjusted. In the depicted exemplary embodiment the distributing device 8 consists of a truncated cone 11 and a distributor plate 12 positioned beneath it; the diameter of the distributor plate 12 is greater than the base of the truncated cone 11. The truncated cone 11 and the distributor plate 12 are securely joined and will ideally consist of a single piece. The radial portion of the distributor plate 12 extending beyond the truncated cone 11 is provided with a surface that rises as it approaches the rim and thus forms an upper surface that curves in concave fashion.

The hollow reactor 1 is closed at its lower, open end by a disk-shaped lid 13. The flat ribs 4 are connected to the rim of the lid 13, so that there are outlet holes bewteen the ribs. The hollow reactor is attached to the end of a hollow shaft 14, which is mounted on bearings 15 in rotating fashion. The bearings 15 are located in a housing 16 that requires cooling. Positioned at the end of the shaft 14 that is removed from the hollow reactor 1 is a drive disk 17 for transmitting the rotation of, e.g., an asynchronous motor (not shown).

To produce fiber materials the reactor is brought to operating temperature before startup by feeding the circulating water vapor into the gap 6. Since the flow of water vapor has a constant temperature and speed, the inner wall of the hollow reactor 1 is evenly heated over its entire surface. The heat flow is drawn inward from the heated surface of the hollow reactor 1 and thus produces the necessary temperature in the entire inner space and keeps it constant. A homogeneous temperature field thus arises over the entire surface of the hollow reactor 1.

After the apparatus is prepared in this way the hollow reactor is made to rotate at a predetermined angular speed. The polymer melt is then introduced through the hollow shaft 14 and the annular distributor gap 10. The melt first reaches the truncated cone 11 and then flows over the distributor plate 12. The speed of the melt flow increases due to the conicity of the truncated cone 11. This speed increases as the melt runs to the edge of the distributor plate 12. The distributor plate 12 thus represents a kind of collecting device which allows the melt to become evenly distributed over the entirety of the plate. Since the surface of the distributor pate 12 rises toward the rim, an additional thickening force arises, such that the melt moves as a homogeneous strip to the periphery of the distributor plate with increasing speed and force. After reaching the rim of the distributor plate 12 the melt strip tears apart and reaches the inner wall of the hollow reactor 1. There the melt film moves downward, the downward motion being supported by the gravitational force brought into play by the vertical design of the hollow reactor 1. After reaching the part of the hollow reactor where the flat ribs 4 are located, the melt film divides into various skeins, which run over the rim 2 and form thin fibers when torn from the edge of the conical rim 2. The threads that have thus arisen and are in the process of cooling are guided into a collecting device by an annular air feed.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A device for producing synthetic fiber materials, with a polymer melt feed leading to a rotating hollow reactor, whose wall can be heated and which widens conically in order to guide a film melt toward an open side that can be closed with a lid, and with ribs for dividing the melt film into fibers that grow rigid after leaving the hollow reactor, wherein the hollow reactor is vertically oriented and exhibits on its curved upper side an opening for introducing the polymer melt, while a rotating distributor plate is positioned opposite the opening, at a slight distance from the inner wall of the hollow reactor.

2. A device according to claim 1, wherein the distance between the distributor plate and the inner wall of the hollow reactor can be adjusted.

3. A device according to claim 1, wherein the distributor plate exhibits a surface that faces the opening and that rises toward the rim.

4. A device according to claim 1, wherein the distributor plate exhibits an upper side that curves in concave fashion and faces the opening.

5. A device according to claim 1, wherein a truncated cone whose outer diameter is smaller than the diameter of the distributor plate is positioned on said distributor plate.

6. A device according to claim 5, wherein the diameter of the truncated cone is on the same order of magnitude as the diameter of the opening of the feed.

7. A device according to claim 1, wherein the inner wall of the hollow reactor is parabolic in shape.

8. A device according to claim 1, wherein the ribs on the inner wall of the hollow reactor run vertical to the rim in the lower area.

9. A device according to claim 1, wherein the hollow reactor, together with a surrounding container, forms a curved gap, to which a steam feed and a steam outlet are attached.

10. A device according to claim 9, wherein the steam feed and the steam outlet are positioned on the upper and lower rim of the hollow reactor.

11. A device according to claim 9, wherein the steam is guided through the gap in circulating fashion.

12. A device according to claim 11, wherein the steam is conducted through the curved gap in the same direction as the melt flowing as a film on the inner wall of the hollow reactor.

* * * * *